United States Patent [19]

Ruf

[11] 4,401,525

[45] Aug. 30, 1983

[54] PROCESS FOR COLORING ALUMINUM ELECTROLYTICALLY WITH METAL SALTS

[75] Inventor: Erich Ruf, Essen, Fed. Rep. of Germany

[73] Assignee: Th. Goldschmidt AG, Essen, Fed. Rep. of Germany

[21] Appl. No.: 93,990

[22] Filed: Nov. 14, 1979

[30] Foreign Application Priority Data

Nov. 18, 1978 [DE] Fed. Rep. of Germany ..... 2850136

[51] Int. Cl.[3] ..... C25D 11/22

[52] U.S. Cl. ..... 204/42; 204/35 N

[58] Field of Search ..... 204/42, 35 N, 58

[56] References Cited

U.S. PATENT DOCUMENTS

| | | | |
|---|---|---|---|
| 4,042,469 | 8/1977 | Hasegawa et al. | 204/42 |
| 4,070,255 | 1/1978 | Hasegawa et al. | 204/42 |

FOREIGN PATENT DOCUMENTS

| | | | |
|---|---|---|---|
| 2384037 | 10/1978 | France | 204/42 |
| 46-20568 | 10/1971 | Japan | 204/35 N |
| 69930 | 11/1944 | Norway | 204/58 |

*Primary Examiner*—G. L. Kaplan

*Attorney, Agent, or Firm*—Toren, McGeady and Stanger

[57] ABSTRACT

A two-step process for electrolytically coloring aluminum with metal salts is disclosed in which an oxide layer, produced by direct current in an acidic solution, is colored by means of an alternating current through an electrolyte containing a tin(II) salt. The electrolyte inventively contains 1 to 10 g/l iron(II) salts of sulfuric acid, a sulfuric acid with at most 8 carbon atoms or of sulfamic acid. The process prevents the formation of deposits in the electrolytes on standing. In addition, a considerable color-enhancing effect can be achieved.

4 Claims, No Drawings

PROCESS FOR COLORING ALUMINUM ELECTROLYTICALLY WITH METAL SALTS

BACKGROUND OF THE INVENTION

1. Field of the Invention

The invention relates to a two-step process for coloring aluminum electrolytically with metal salts using a direct current in an acidic solution to produce a defined oxide layer and then coloring the layer using an alternating current in an acidic electrolyte which contains tin(II) salts.

2. Description of the Prior Art

According to the state of the art, processes for coloring anodized aluminum are divided into chemical processes and electrolytic processes.

Chemical processes for coloring involve coloring of anodized aluminum in an aqueous phase with suitable organic and/or inorganic compounds without the use of a current. Electrolytic coloring may be carried out in one or two steps.

For the one-step electrolytic process, aluminum is generally anodized as well as colored in a single step using direct current in an electrolyte composed of sulfuric acid in admixture with suitable organic acids, such as, for example, maleic acid, oxalic acid, sulfosalicylic acid or sulfophthalic acid.

With the two-step electrolytic process, the so-called electrolytic coloring with metal salts, a defined oxide layer is produced initially in a first process step using direct current with sulfuric acid or sulfuric acid and oxalic acid as the electrolyte liquid. The thus anodized aluminum is then colored electrolytically in a second process step, using alternating current and solutions of certain metal salts or mixtures of metal salts.

The electrolytic process is used predominantly for coloring aluminum because it produces higher light stability in the color and is more efficient economically. Because of the lower costs involved, electrolytic coloring with metal salts is clearly the predominant electrolytic process. In this process, solutions containing tin(II) sulfate are preferably used.

In the two-step process, when using solutions containing tin(II) sulfate for electrolytically coloring aluminum, shades of color can be produced which, depending on the operating conditions chosen, range from silvery, through light, medium or dark bronze, to black and which are resistant to light and to normal atmospheric effects. As a result of hydrolysis and/or oxidation, however, sulfuric acid solutions of tin(II) sulfate, of the type used for the electrolytic coloring of aluminum with metal salts, deposit, to an increasing degree depending on their age, difficulty soluble tin compounds which are ineffective for coloring aluminum.

Attempts have been made to reduce the deposition of such difficulty soluble tin compounds by the addition of suitable compounds, such as, for example, phenolsulfonic acid, cresolsulfonic acid, phenol or its derivatives. Because of their harmful effects on effluent water, their toxicity as well as their odor, these compounds are now classified as environmental contaminants. Additionally, such compounds do not adequately suppress the formation of difficulty soluble tin compounds.

SUMMARY OF THE INVENTION

We have discovered compounds which do not have these disadvantages and therefore are more compatible with the environment and which almost completely prevent the formation of deposits in tin(II)-containing solutions on standing.

This is achieved by using, in the two-step process, a tin(II) salt containing electrolyte which contains 1 to 10 g/l of one or more iron(II) salt(s) of acids from the group comprising sulfuric acid, a sulfonic acid with at most 8 carbon atoms or sulfamic acid.

This effect is particularly surprising because the free acids, such as, for example, sulfuric acid, phenolsulfonic acid and sulfamic acid, do not themselves prevent the formation of deposits.

DESCRIPTION OF THE PREFERRED EMBODIMENT

The additions are effective in an amount of 1 to 10 g/l. Preferably, about 5 g/l of one or several of the compounds in accordance with the present invention are added to the sulfuric acid electrolyte which contains the tin(II) salts.

If iron(II) salts of a sulfonic acid are used, the hydrocarbon residue, which is connected to the sulfur atom and which may contain up to 8 carbon atoms inclusive, plays an insignificant role. The hydrocarbon residue optionally may be a substituted alkyl, aryl or alkaryl residue.

It is a particular advantage of the present process that the addition of the aforementioned iron(II) salts results not only in the suppression of the formation of difficultly soluble deposits, but also in a considerable color-enhancing effect in many cases.

From the point of view of the color-enhancing effect as well as of the suppression of difficultly soluble tin-containing deposits, a particularly preferred embodiment of the inventive process consists in using iron(II) sulfosalicylate and/or iron(II) sulfophthalate as the iron(II) salt containing electrolyte.

The same effects of color enhancement and suppression of difficultly soluble deposits can also be achieved by adding 1 to 10 g/l of free sulfosalicylic acid and/or sulfophthalic acid to the iron(II) salt containing electrolyte.

The electrolytes used in the process of the present invention may contain other conventional additives. For example, it is possible to add amines or phenols or phenol derivatives to these solutions using known procedures.

It is thus possible with the present invention to simply, economically and practically completely prevent the formation of difficultly soluble deposits in sulfuric acid solutions of tin(II) salts and to achieve, at the same time, a deeper shade when coloring aluminum.

The effectiveness of the compounds, contained in the electrolyte of the present invention was determined by allowing a test solution to stand for 1 week. The test solution consisted of 200 ml of a sulfuric acid solution of tin sulfate, such as is used for the electrolytic coloring of aluminum. This solution contained 14 g of tin(II) sulfate and 16 g of concentrated sulfuric acid per liter as such and in each case, in addition, the compounds mentioned in the following table. The deposits formed were filtered off and the amounts determined gravimetrically.

In addition, previously anodized aluminum was colored electrolytically with the individual solutions. After burnishing and drying, the brightness (L) of the colored aluminum plate obtained was determined with a colorimeter and a color difference meter, the instrument being calibrated from 0 to 100, 100 being white and 0 being black. Accordingly, it was possible to objectively determine the brightness differences.

TABLE

A sulfuric acid solution of tin sulfates with 14 g of tin(II) sulfate and 16 g of sulfuric acid per liter was used as the electrolyte.

| | Type and Amount of Additive | Amount of Deposit Formed in mg | Brightness (L) |
|---|---|---|---|
| | without additives | 1000 | 22.0 |
| Group I | 5 g/l phenolsulfonic acid | 480 | 16.8 |
| | 5 g/l cresolsulfonic acid | 20 | 14.8 |
| | 5 g/l sulfamic acid | 130 | 22.0 |
| | 5 g/l sulfosalicyclic acid | 190 | 15.0 |
| | 5 g/l sulfophthalic acid | 570 | 15.2 |
| | 10 g/l pentaethylenehexamine | 880 | 20.2 |
| | 10 g/l aminoethylethanolamine | 820 | 19.0 |
| Group II | 5 g/l iron(II) sulfate | 6 | 21.8 |
| | 5 g/l iron(II) sulfamate | 4 | 18.8 |
| | 5 g/l iron(II) sulfosalicylate | 4 | 12.7 |
| | 5 g/l iron(II) p-toluenesulfonate | 7 | 18.4 |
| | 5 g/l iron(II) sulfophthalate | 5 | 12.9 |
| | 5 g/l iron(II) hydroxyethane sulfonate | 7 | 19.2 |
| | 5 g/l iron(II) methanesulfonate | 6 | 18.4 |
| Group III | 5 g/l iron(II) sulfamate + 5 g/l sulfosalicyclic acid | 4 | 12.6 |
| | 5 g/l iron(II) sulfamate + 5 g/l sulfophthalic acid | 5 | 12.7 |
| | 5 g/l iron(II) sulfate + 5 g/l sulfosalicylate acid | 4 | 13.2 |
| | 5 g/l iron(II) sulfate + 5 g/l sulfophthalate acid | 7 | 13.4 |

In Group I, the free acids and amines conventional in the art are shown. Particularly, phenolsulfonic acid, cresolsulfonic acid and sulfamic acid are added to the sulfuric acid solution of tin sulfate. With the exception of cresolsulfonic acid, which has harmful effects on the environment, the supression of the formation of the tin-containing deposit is completely inadequate.

The results from Group II showed that the tin-containing deposit formed is practically negligible when the compounds in accordance with the present invention are used. The depth of shade of the colored aluminum is not impaired. When using iron(II) sulfosalicylate and iron(II) sulfophthalate, a clear enhancement of color intensity is also obtained. When using iron(II) sulfamates and iron(II) sulfonates, a perceptible enhancement of color intensity is obtained.

The additives according to Group III on the other hand prevent the formation of practically any deposits while the color intensity of the colored aluminum is in all cases appreciably increased. It therefore follows that the inventively mentioned iron(II) compounds are certain to suppress the formation of deposits in tin(II) sulfate-containing solutions, the iron(II) sulfonates and iron(II) sulfamates as such or in combination with sulfosalicylate acid or sulfophthalate acid in addition leading to an enhancement of the color intensity.

The present invention is illustrated in the following examples.

EXAMPLE 1

An aluminum plate (100 mm×50 mm×2 mm) was defatted by a conventional procedure and etched with alkali and acid. Between the individual steps, the plate was rinsed with water. Using a direct current, the plate was anodized using aqueous sulfuric acid (200 g of concentrated sulfuric acid per liter) as the electrolyte liquid in such a manner that an anodized layer of 20 μm was produced (cathode material: high-grade steel; current density: 1.3 to 1.5 amp/dm$^2$).

The anodized aluminum plate was rinsed with water and immersed in 300 ml of an electrolyte liquid in a rectangular glass cell. The electrolyte liquid contained 14 g of tin(II) sulfate, 16 g concentrated sulfuric acid and 5 g of iron(II) sulfosalicylate per liter. The electrolytic coloring with metal salts was carried out within 5 minutes using two high-grade steel electrodes, to which an alternating current was applied at an electrolyte temperature of 18° to 20° C. The voltage was carefully regulated continuously at 15 volts during the first minute and kept constant for 4 minutes. After the coloring process, the colored aluminum plate was burnished using a conventional procedure. The brightness value, determined with the colorimeter was 12.7. After a standing period of 1 week, the amount of material which had deposited from 200 ml of the same electrolyte liquid was 4 mg.

Comparison Experiment

The procedure was identical with that in Example 1. However, instead of the electrolyte liquid mentiond in Example 1, a sulfuric acid solution of tin(II) sulfate was used which contained 14 g of tin(II) sulfate and 16 g of concentrated sulfuric acid per liter.

The brightness, determined with the colorimeter was 22.0. After standing for 1 week, the amount of material which had deposited from 200 ml of this solution was 1000 mg.

EXAMPLE 2

The procedure was similar to that described in Example 1. As the electrolyte liquid, a solution was used which contained 14 g of tin(II) sulfate, 16 g of concentrated sulfuric acid and 5 g per liter of iron(II) sulfamate.

The brightness determined with the colorimeter was 18.8. After 1 week, 6 mg of material had deposited from 200 ml of this solution.

EXAMPLE 3

The procedure was similar to that described in Example 1. As the electrolyte liquid, a solution which contained 14 g of tin(II) sulfate, 16 g of concentrated sulfuric acid, 5 g of iron(II) sulfate and 5 g of sulfophthalic acid per liter was used.

The brightness measured with the colorimeter was 13.4. After standing for 1 week, 7 mg of material had deposited from 200 ml of this solution.

EXAMPLE 4

The procedure was similar to that described in Example 1. As the electrolyte liquid, a solution was used which contained 14 g of tin(II) sulfate, 16 g of concentrated sulfuric acid and 5 g of iron(II) sulfamate, as well as 10 g of aminoethylethanolamine per liter.

The brightness, measured with the colorimeter, was 18.1. After a period of 1 week, 46 mg of material had deposited from 200 ml of this solution.

Comparison Experiment

The procedure was similar to that described in Example 1. As the electrolyte liquid a solution was used that contained 14 g of tin(II) sulfate, 16 g of concentrated sulfuric acid and 10 g of aminoethylethanolamine per liter.

The brightness, determined with the colorimeter, was 19.0. After a period of 1 week, 820 mg of material had deposited from 200 ml of this solution.

EXAMPLE 5

The procedure was similar to that described in Example 1. As the electrolyte liquid, a solution was used which contained 14 g of tin(II) sulfate, 16 g of concentrated sulfuric acid, 10 g of phenolsulfonic acid and 5 g of iron(II) sulfamate per liter.

The brightness, determined with the colorimeter, was 15.8. After a period of 1 week, 66 mg of material had deposited from 200 ml of this solution.

Comparison Experiment

The procedure was similar to that described in Example 1. As the electrolyte liquid, a solution was used which contained 14 g of tin(II) sulfate, 16 g of concentrated sulfuric acid and 10 g of phenolsulfonic acid per liter.

The brightness, determined with the colorimeter was 16.5. After a period of 1 week, 420 mg of material had deposited from 200 ml of this solution.

EXAMPLE 6

The procedure was similar to that described in Example 1. As the electrolyte liquid, a solution was used which contained 14 g of tin(II) sulfate, 16 g of concentrated sulfuric acid, 10 g of cresolsulfonic acid, and 5 g or iron(II) sulfamate per liter.

The brightness, determined with the colorimeter, was 13.8. After a period of 1 week, 8 mg of material had deposited from 200 ml of this solution.

Comparison Experiment

The procedure was similar to that used in Example 1. As the electrolyte liquid, a solution was used which contained 14 g of tin(II) sulfate, 16 g of concentrated sulfuric acid and 10 g of cresolsulfonic acid per liter.

The brightness, determined with the colorimeter, was 14.5. After a period of 1 week, 18 mg of material had deposited from 200 ml of this solution.

What is claimed is:

1. In a process for electrolytically coloring aluminum with metal salts wherein by means of a direct current in an acidic solution, a refined oxide layer is produced on the aluminum and the layer is subsequently colored by means of an alternating current using an acidic electrolyte which contains tin(II) salts, the improvement which comprises said electrolyte also containing 1–10 g/l of iron(II) salts selected from the group consisting of iron(II) sulfosalicylate and iron(II) sulfophthalate.

2. The process of claim 1 wherein the electrolyte additionally contains 1 to 10 g/l of sulfosalicylic acid and/or sulfophthalic acid.

3. The process of claim 1 wherein the amount of iron(II) salt is about 5 g/l.

4. In a process for electrolytically coloring aluminum with metal salts wherein by means of a direct current in an acidic solution, a refined oxide layer is produced on the aluminum and the layer is subsequently colored by means of an alternating current using an acidic electrolyte which contains tin(II) salts, the improvement which comprises said electrolyte also containing 1 to 10 g/l of one or more iron(II) salts of sulfonic acids with a maximum of 8 carbon atoms or of sulfamic acid and free sulfosalicylic acid or free sulfophthalic acid.

* * * * *